US007057510B2

(12) United States Patent
Maniaci

(10) Patent No.: US 7,057,510 B2
(45) Date of Patent: Jun. 6, 2006

(54) DOOR CONDITION SENSOR FOR SAFES AND SECURED AREAS

(75) Inventor: Anthony C. Maniaci, Victorville, CA (US)

(73) Assignee: American Security Products Company, Fontana, CA (US)

( * ) Notice: Subject to any disclaimer, the term of this patent is extended or adjusted under 35 U.S.C. 154(b) by 310 days.

(21) Appl. No.: 10/777,272

(22) Filed: Feb. 11, 2004

(65) Prior Publication Data

US 2005/0174237 A1 Aug. 11, 2005

(51) Int. Cl.
*G08B 13/08* (2006.01)

(52) U.S. Cl. ..... 340/545.6; 340/545.1; 340/545.2

(58) Field of Classification Search ..... 340/545.1, 340/545.2, 545.8, 570, 543, 545.6, 686.1, 340/686.3; 40/524
See application file for complete search history.

(56) References Cited

U.S. PATENT DOCUMENTS 4,904,984 A 2/1990 Gartner et al. ..... 340/543
5,083,122 A * 1/1992 Clark ..... 340/5.22
5,572,190 A * 11/1996 Ross et al. ..... 340/541
5,617,082 A 4/1997 Denison et al. ..... 340/825.31
5,774,059 A * 6/1998 Henry et al. ..... 340/5.54
5,942,974 A * 8/1999 Pfreundschuh et al. .. 340/545.6
6,098,433 A 8/2000 Maniaci ..... 70/278.1
6,891,479 B1 * 5/2005 Eccleston ..... 340/686.1

* cited by examiner

*Primary Examiner*—Jeffery Hofsass
*Assistant Examiner*—Hoi C. Lau
(74) *Attorney, Agent, or Firm*—F. Eugene Logan

(57) ABSTRACT

A door condition sensor for a safe having a door. The sensor has a housing mounted on an inside surface of the door, frame engageable means for abutting the door frame, a driver rotatably mounted in the housing, analog signal generator mounted in the housing having a rotatable part driven by the driver, and spring for extending the frame engageable means that is slideably mounted and confined to linear displacement in the housing. The driver transforms displacement of the frame engageable means into rotational orientation of the driver. The generator produces analog signals corresponding to the rotational orientation of the rotatable part. A means converts analog signals from the generator to corresponding digital signals that are proportional to displacement of the frame engageable means. Memory means compares the displacement with a set point range thereby continually monitoring the condition of the door.

27 Claims, 10 Drawing Sheets

DOOR CONDITION SENSOR FOR SAFES AND SECURED AREAS

BACKGROUND OF THE INVENTION

Electronic combination locking systems for controlling entry to safes are now widely used in vault doors and especially in small to medium size safes. Such digital combination locking systems have included, for example, individual access codes for authorized personnel to use for opening safes. Automatic recordation of entry times associated with user access codes have also been used. Ability to retrieve records of such events at a later date and automatic alarms have also been used with locking systems for safes. Examples of the art in electronically controlled locking systems can be found in U.S. Pat. Nos. 4,904,984 and 5,617,082.

However, in order to provided further security to such electronically controlled locking systems against misuse by authorized users and against burglars, continual improvement in electronically controlled locking systems is needed.

This invention provides additional security by enabling continuous monitoring of the condition of safe and vault doors or other entry doors to a secured areas without the use of a camera or closed circuit television. It is also an object of this invention to provide a relatively inexpensive and reliable door monitoring means for use with electronically controlled locks.

BRIEF SUMMARY OF THE INVENTION

The door condition sensor of this invention is for use with electronic access control devices include electronic combination locks, for use with safes, and especially electronic locking systems having memory means for entry to secure areas. Such locking systems including locking apparatus using local area network communication systems to control access to safes having a plurality of doors such as an outer door with a lower level of security and an inner door with a higher level of security.

In particular, with reference to FIG. 1, a schematic diagram of an electronic locking system of this invention is shown having power supply means 150 with power AC-adapter connector 151 electrically linked by cables 101, 102 and 103 to outer electronic lock/memory means 200 and inner electronic lock/memory means 210. Means 200 and 210 are electrically linked to controller/memory means 160. Controller/memory means 160 has a keypad 161 for inputting user information and display screen 162 for viewing output information such as door condition status information. Means 200 and 210 have door handles 201 and 211, respectively, for physically unlocking and locking the locks when proper input codes have been entered to the system. Door handle 201 extends through door 22, for example an outer door, with the remainder of means 200 secured to the inside of door 22. Door handle 211 extends through door 212, for example an inner door, with the remainder of means 210 secured to the inside of door 212. Power supply means 150 has printer port 152 for connecting to a printer or other device for retrieval of audit data stored in the memory of the system. Power AC-adapter connector 151 is connected to power supply means 150 by cable 104.

This invention features a door condition sensor or sensors 20 that senses the condition of a door or doors in or to the safe or secure area. In this embodiment, one sensor monitors the condition of outer door 22 and the other sensor monitors the condition of inner door 212. Each door condition sensor 20 is mounted on the interior surface of the safe door the condition of which is to be monitored. Each sensor 20 is electrically linked by cables 100 to a particular lock for the monitored door as shown schematically in FIG. 1. The system's memory continually monitors the condition of the safe door and creates an auditable record of that condition. Means 160 is secured to the outside of the safe at a convenient location. Means 150, also secured to the safe, can be located at any convenient location inside or outside the safe. FIGS. 2–15 describe the details of door condition sensor 20 and the relationship between sensor 20 and the locking system of FIG. 1.

DETAILED DESCRIPTION OF THE PREFERRED EMBODIMENT

Figure 2:
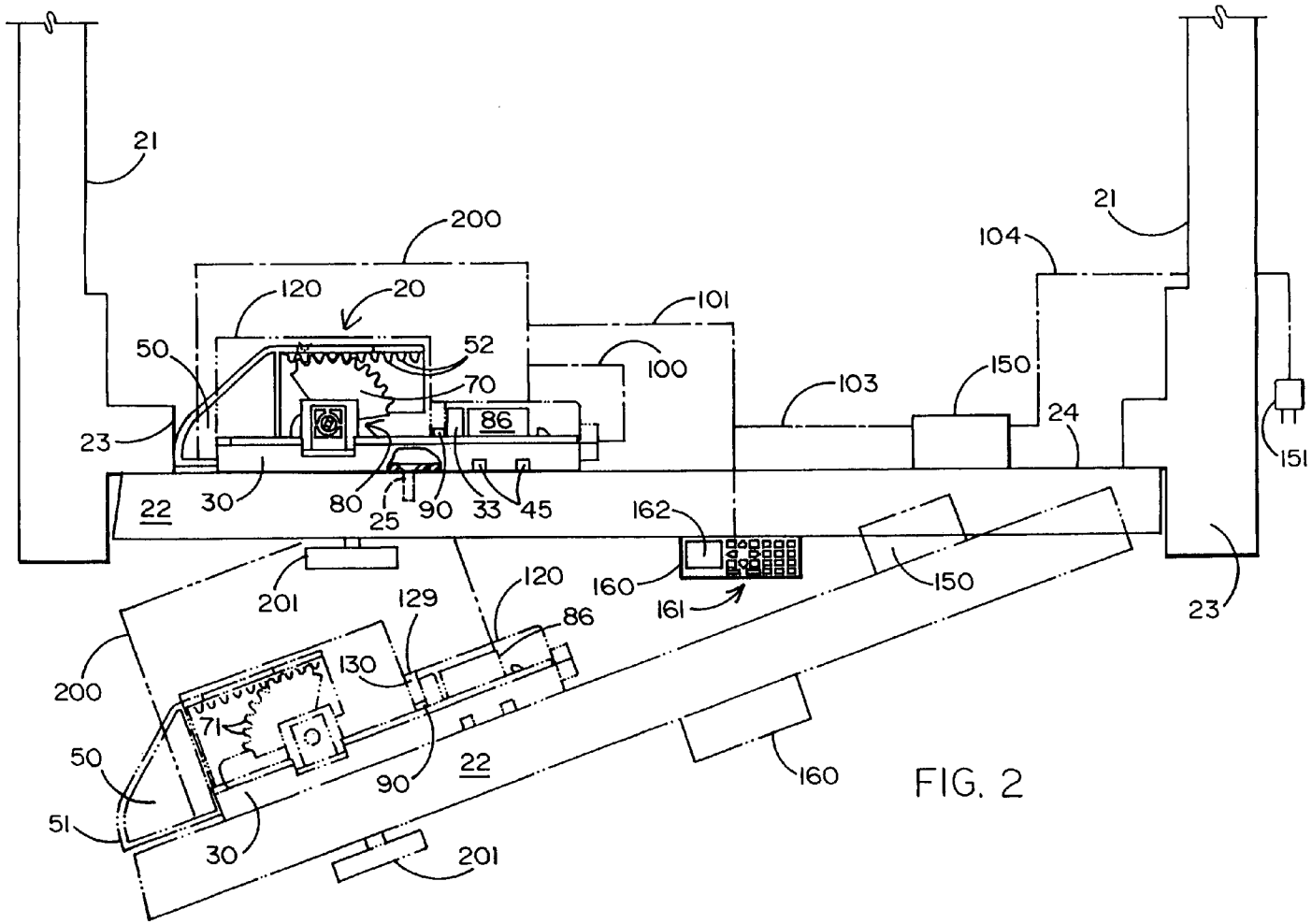
FIG. 2 top view of the door condition sensor and electrical components as mounted on a safe door.
Figure 3:
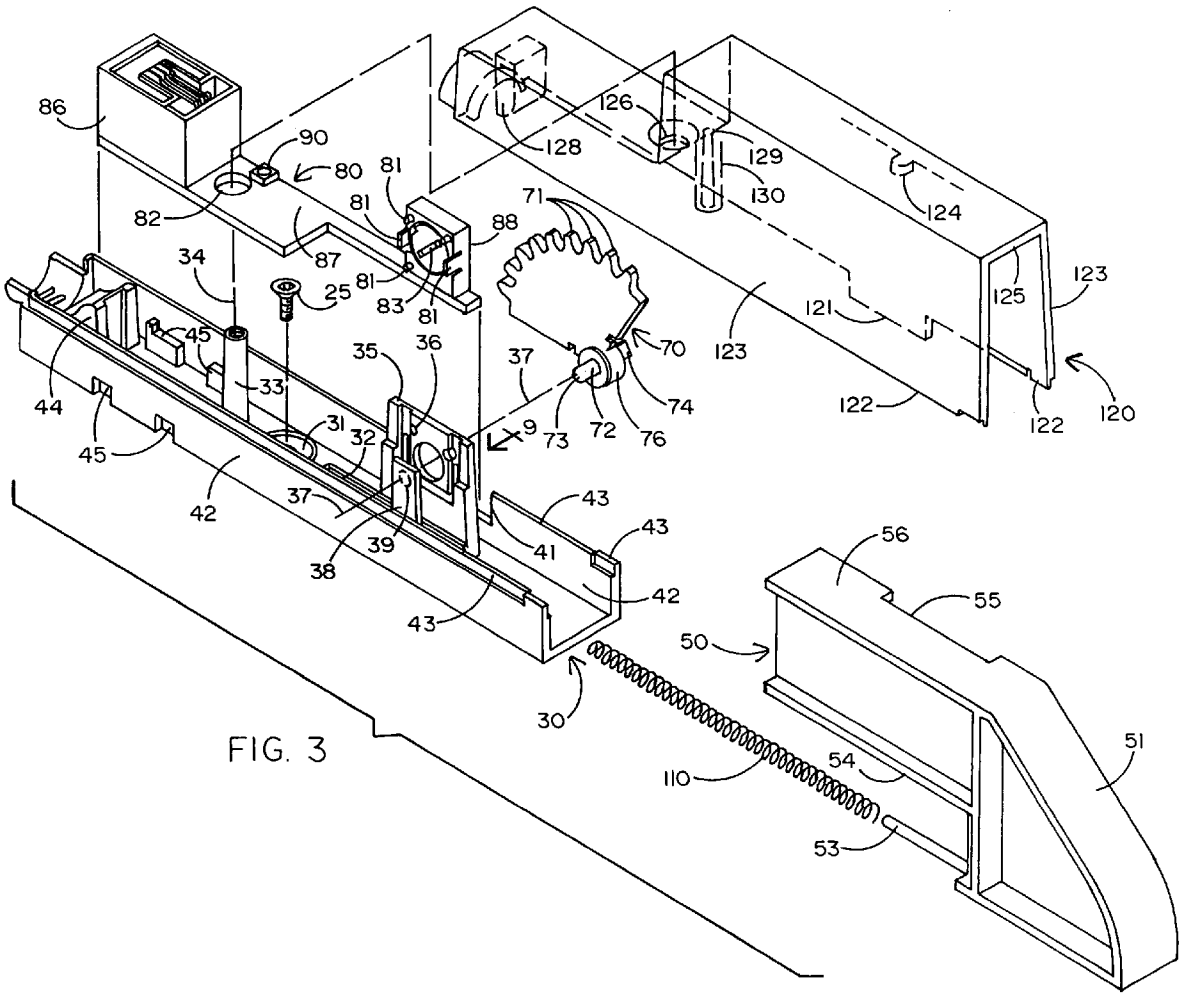
FIG. 3 is an exploded view of the door condition sensor of FIG. 2 as seen from the opposite side thereof.
Figure 4:
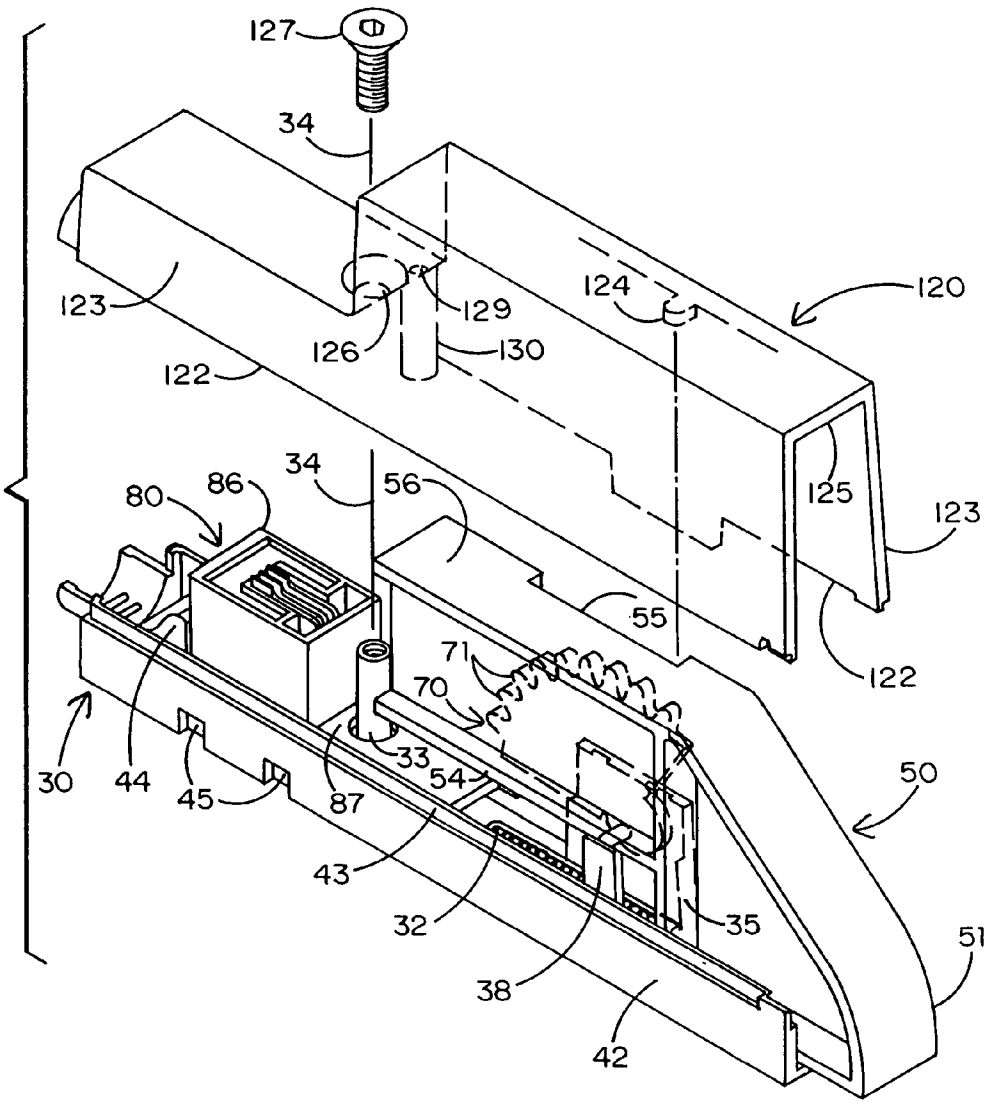
FIG. 4 is a partially assembled view of the door condition sensor of FIG. 3 in a retracted state.
Figure 5:
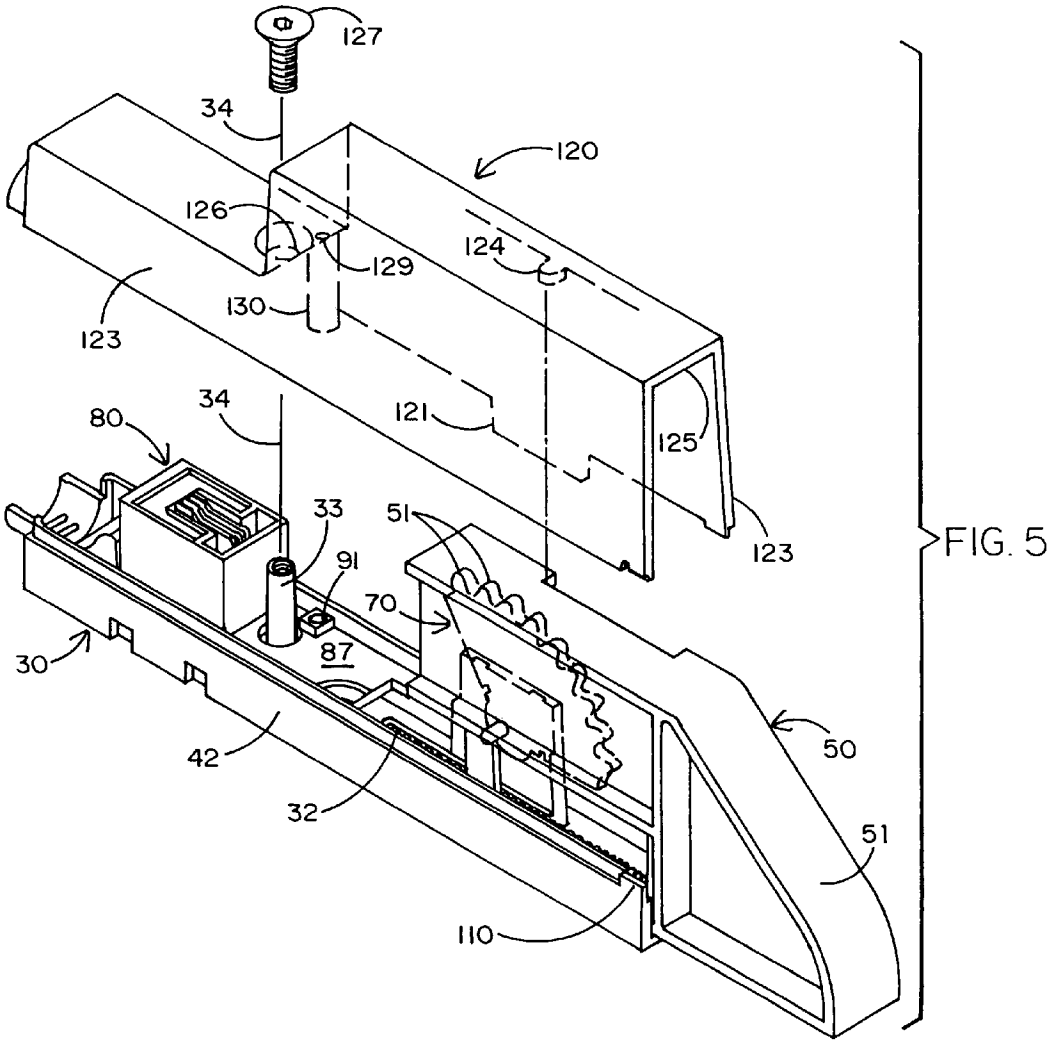
FIG. 5 is a partially assembled view of the door condition sensor of FIG. 3 in a fully extended state.

The use of the terms "up", "upstanding", "down" and "downstanding" as used herein refers only to the orientation of elements as they appear in the FIGS. 3–6 and 8 and not to actual orientation of such elements when mounted on a vertical door of a safe or vault. The actual orientation of such elements when incorporated in a safe or vault is preferably as shown in FIG. 2. FIGS. 3–6 and 8 are rotated 90° to FIG. 2.

FIG. 2 shows a door condition sensor 20 of this invention in both the door closed position and the door opened position, with the latter shown in phantom. In particular, door condition sensor 20 is shown installed on a chamber 21, for example a safe or vault, having a door 22 and a door frame 23 therefor. Door condition sensor 20 is mounted to the inside surface 24 of door 22. As opposed to FIG. 1, FIGS.

Figure 1:
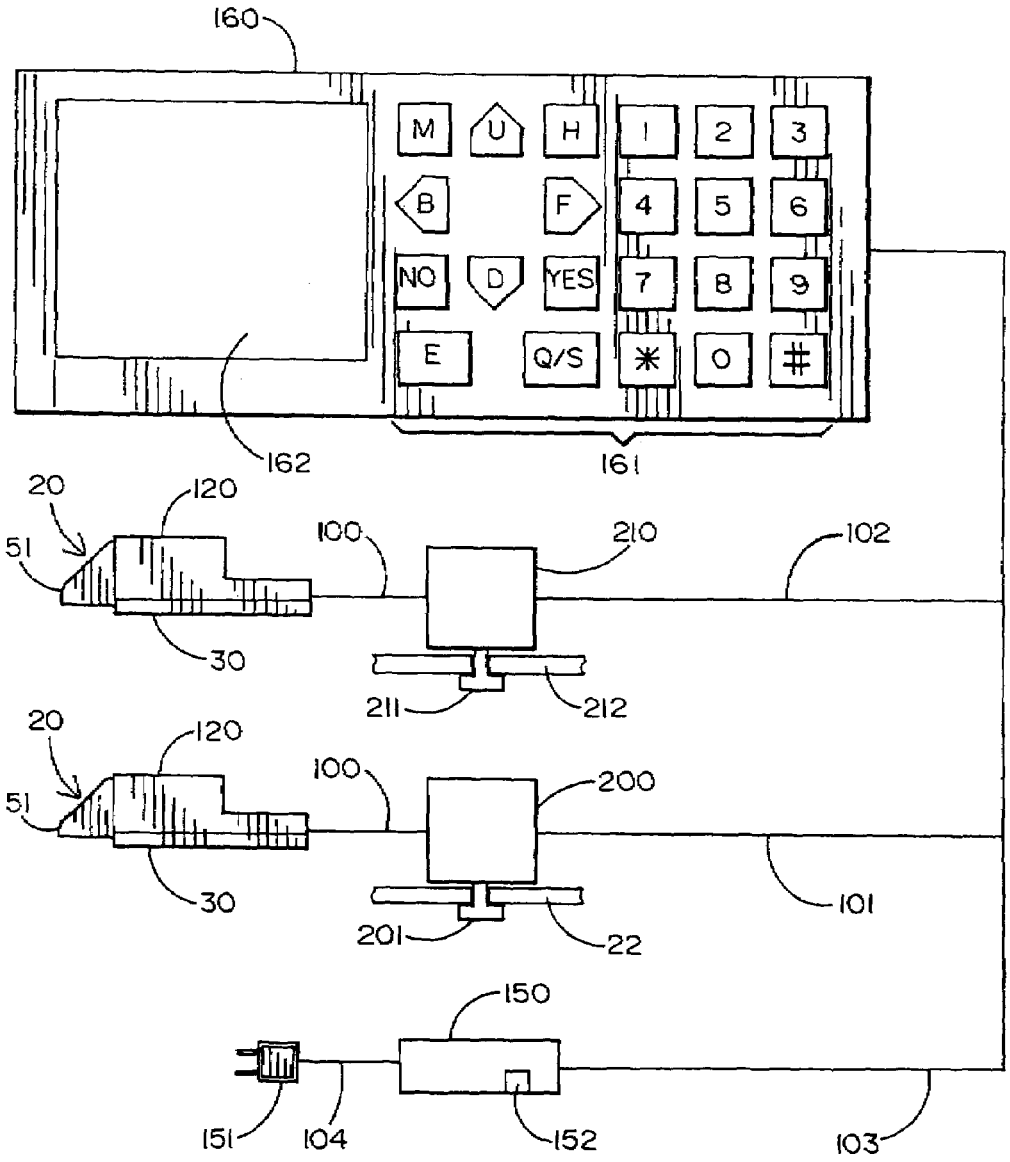
FIG. 1 is a schematic of the door condition sensors of this invention and associated electronic locking components used therewith.

2–15 are illustrative of a single electronically controlled lock systems. However, system with a plurality of doors having electronically controlled locks, as shown in FIG. 1, will function in a similar manner.

With reference to FIGS. 2–12, door condition sensor 20 comprises a sensor housing 30, door frame engageable means 50, rotatable driver means 70, analog signal generator means 80, biasing means 110, and a housing cover 120.

The base portion of sensor housing 30 has an opening 31 for insertion of fastener 25 for securing housing 30 to the inside surface 24 of door 22. Housing 30 has an internal channel 32 for insertion of biasing means, which in this embodiment, is a coil extension spring 110.

Housing 30 also has an upstanding hollowed internally threaded post 33 having axis 34. An upstanding potentiometer bracket 35 having axis 37 and several small traverse openings 36, is provided for receiving small conjunctively-shaped snap-in mounting prongs 81 of analog signal generator means 80. Analog signal generator means 80 is mounted in housing 30 by first inserting opening 82 down over post 33 and then inserting snap-in-place mounting prongs 81 in openings 36 thereby completing the mounting of analog signal generator means 80 in housing 30 with the base of circuit board 87 resting on supports 45 and 46.

Door frame engageable means 50 has a ramp-shaped leading surface 51 for striking and abutting the jamb of door frame 23 as door 22 is closed, so that frame engageable means 50 is easily displaced into the sensor housing 30.

Rotatable driver means 70 is a segmented gear having outwardly extending gear teeth 71 and shaft 72. When assembled in housing 30, the axis of brackets 35 and 38 of shaft 72 coincides with the axis 37 of housing 30. One end 73 of shaft 72 is rotatably supported by upstanding shaft support bracket 38 of housing 30. Support bracket 38 has a hemispherical central cup depression 39 and flat uppermost support surface 40. When sensor 20 is assembled the axes of cup depression 39 and shaft 72 coincide with the axis 37 of housing.

The opposite end 74 of shaft 72 has a cross-sectional shape designed to fit into a complementary shaped axial opening 83 in rotatable part 84 of analog signal generator means 80. In the embodiment shown in the figures, the cross-sectional shape of opening 83 is rectangular. In this embodiment, hemispherically shaped end 73 of shaft 72 is rotatably supported by hemispherically shaped cup depression 39 in support bracket 38 and rectangular opening 83 in rotatable part 84 of potentiometer 85. The shape of opening 83 need not be rectangular but must be such that as shaft turns part 84 turns.

Figure 6:
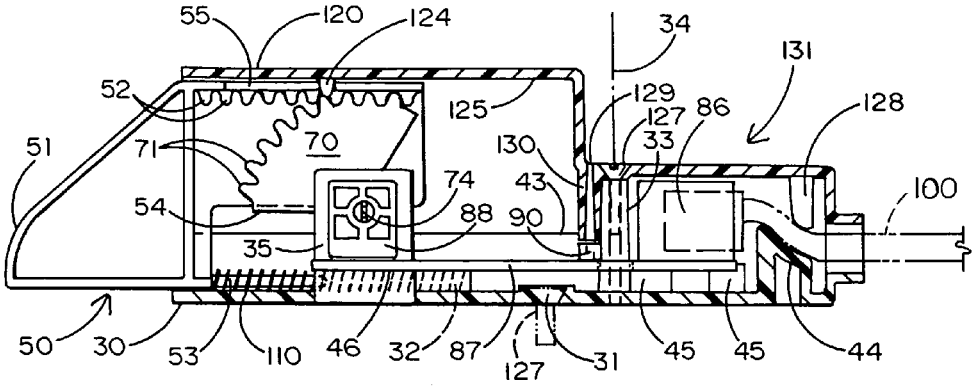
FIG. 6 a cross-sectional view of the door condition sensor in a fully extended state from the opposite side of that shown in FIG. 5.
Figure 7:
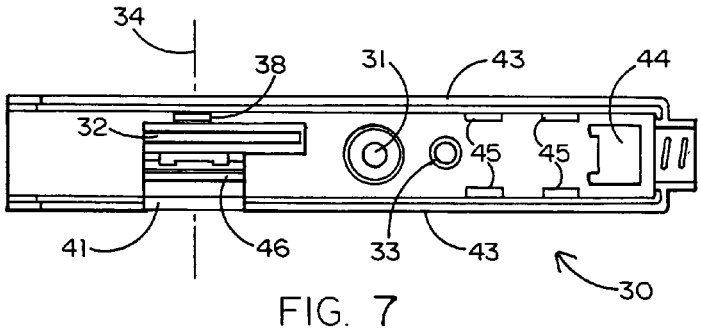
FIG. 7 is a top view of the sensor housing of the door condition sensor of FIG. 6.
Figure 8:
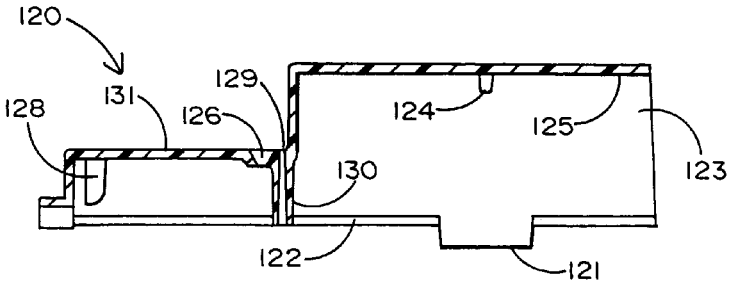
FIG. 8 is cross-sectional view of the housing cover of the door condition sensor of FIG. 6 from the opposite side of that shown in FIG. 6.
Figure 9:
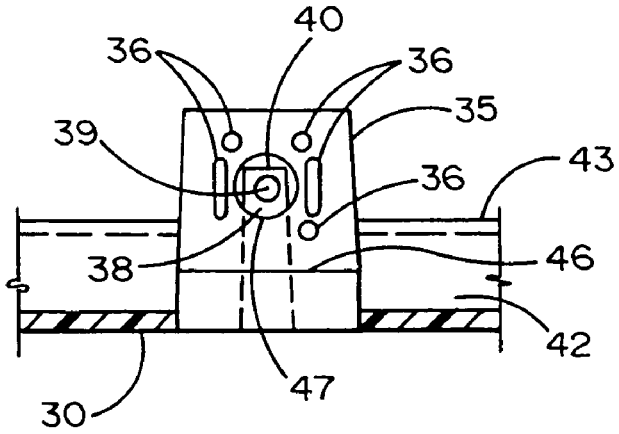
FIG. 9 is a detail of encircled Section 9 of FIG. 3 as seen from the opposite side thereof.
Figure 10:
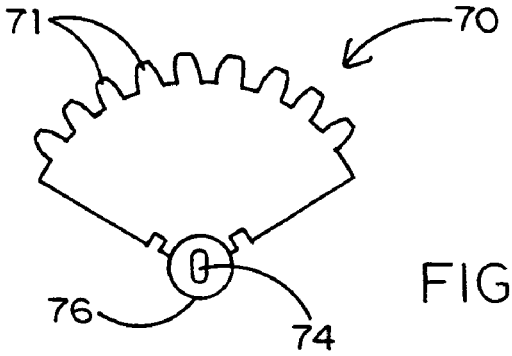
FIG. 10 is a front view of the rotatable driver of the door condition sensor of FIG. 6.
Figure 11:
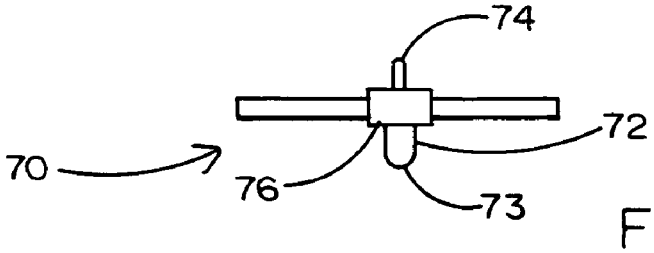
FIG. 11 is a top view of the rotatable driver of FIG. 10.

Frame engageable means 50 has a linear set of gear teeth 52 downwardly extending for engaging complementary outwardly extending gear teeth 71 of the rotatable driver means 80 as best seen in FIG. 6. Therefore, as frame engageable means 50 slides into and out of housing 30, gear teeth 52 of means 50 engage gear teeth 71 of means 70 and drive rotatable driver means 70 which in turn rotates rotatable part 84 of potentiometer 85 of analog signal generator means 80.

To maintain ramp-shaped leading surface 51 outwardly extended and against door frame 23, one end of coil extension spring 110 is inserted into internal channel 32 of housing 30. The other end of spring 110 is inserted over elongated prong 53 of frame engageable means 50. When sensor 20 is assembled, spring 110 is confined entirely to channel 32 and prong 53, thereby maintaining spring 110 in a straight line and preventing it from becoming dislodged. Coil extension spring 110 is designed to be strong enough to extend frame engageable means 50 outward from housing 30 sufficiently to maintain ramp-shaped leading surface 51 against the jamb of door frame 23 when door 22 is closed or nearly closed but not strong enough to interfere with, or prevent, the closing of door 22.

A lower edge 54 of frame engageable means 50 rests on the flat uppermost surface 40 of support bracket 38 thereby preventing means 50 from tilting downwardly into housing 30.

Housing cover 120 has a downstanding alignment tab 121 extending from the lower edge 122 of one sidewall that is received in upstanding alignment recess 41 of housing 30. Insertion of alignment tab 121 into recess 41 registers cover 120 in exact longitudinal alignment with housing 30.

Sensor housing 30 has parallel upstanding sidewalls 42 having recessed upper edges 43 for registry with conjunctively-recessed lower edges 122 of parallel downstanding sidewalls 123 of housing cover 120 thereby maintaining cover 120 in exact alignment traversely with housing 30.

To limit the travel of frame engageable means 50 relative to housing 30, frame engageable means 50 has a linear stop slot 55 approximately equal in length to the total extension of means 50 from housing 30. Slot 55 is a three-sided rectangular shaped notch or opening in this embodiment. Housing cover 120 has a downstanding internal stop 124 that is positioned within the stop slot 55 when the cover 120 is fastened to housing 30. Slot 55 and stop 124 confine the linear movement of the frame engageable means 50 approximately between closed-door position and an opened door or out-of-set-point position, that is away from door frame or door jamb 23 as shown in the phantom-lined projection of opened door 22 of FIG. 2 and FIG. 6.

Housing cover 120 has an inside flat top surface 125 that when sensor 20 is assembled has a very small clearance between outer flat top surface 56 of frame engageable means 50 and surface 125 thereby further preventing means 50 from tilting within the assembled sensor 20.

Housing cover 120 also has an opening 126 alignable with internally threaded post 33 through which fastener 127 is screwed to secure cover 120 to housing 30, thereby simultaneously securing and entirely confining all components of door condition sensor 20 in the assembled housing 30 and cover 120 except for the extended part of frame engageable means 50.

Lower internal cable compressive buttress 44 in housing 30 in conjunction with upper internal cable compressive buttress 128 in housing cover 120 squeeze and thereby anchor electrical cable 100 in the assembled housing 30 and cover 120. A male telephone-type jack located at one distal end of cable 100 is snap connected into female telephone-type jack 86 of analog signal generator means 80. Cable 100 provides constant input signal or voltage to and analog signal output from, analog signal generator means 80.

Figure 12:
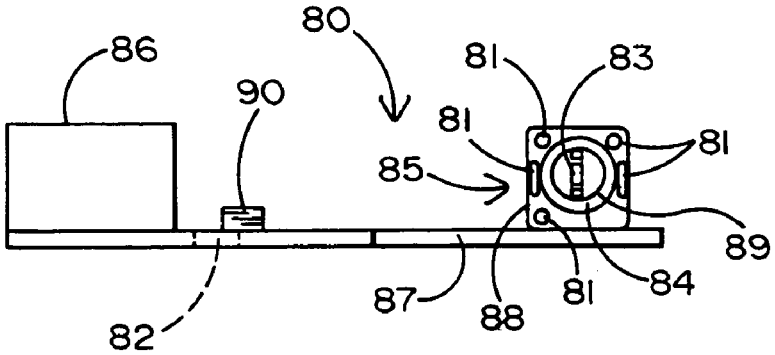
FIG. 12 is a side view of the analog signal generator means of the door condition sensor as seen from the opposite side of FIG. 6.

Female jack 86 is electrically connected to base circuit board 87 of analog signal generator means 80, which is electrically connected to potentiometer 85. As shown in FIG. 12, potentiometer 85 has an upstanding stationary part 88 and a complementary rotatable part 84 that is rotatably mounted in stationary part 88. When assembled the axis of parts 88 and 84 coincides with axis 37 of upstanding potentiometer bracket 35 and cup recess 39 of support bracket 38 of housing 30.

To augment axial alignment of shaft 72 of rotatable driver means 80 to rotatable part 84 of potentiometer 85, part 84 has a small width and small height annular boss 89 into which a portion of enlarged central cylindrical axial portion 76 of shaft 72 fits. The outer cylindrical surface of annular boss 89 fits within central circular opening 47 of potentiometer bracket 35. The small width of annular boss 89 separates axial portion 76 from opening 47. Because the width of boss 89 is small, for example about 0.016 inches, boss 89 is merely shown as a circle in FIG. 12. The small height of annular boss 89 provides no detrimental resistance to the rotation of axial portion 76 of rotatable driver means 70 in central circular opening 47 in potentiometer bracket 35 thereby enabling potentiometer 85 to function with no detrimental mechanical resistance as a result of the rotation of rotatable driver means 70 and rotatable part 84.

Circuit board 87 also contains a light 90, for example a light emitting diode, that is lit when power is provided to analog signal generator means 80. A small beam of light, emitted from light 90 and shone through small aperture 129 immediately above downstanding annular member 130 in cover 120, indicates that the power is on to sensor 20. Light 90 serves as a diagnostic indicator for troubleshooting. Annular member 130 abuts light 90 on base circuit board 87 thereby also holding board 87 down against circuit board supports 45 and 46 and channeling the light to aperture 129. Upper buttress 128 and annular member 130 depend from a section 131 of cover 120. The height of section 131 provides little clearance between it and the top of female jack 86 thereby further preventing any detrimental movement of jack 86 within the door condition sensor.

Referring to FIG. 2, electrical power input is provided to electronic lock/memory means 200 from power supply means 150 by cables 103 and 101. Output signal from means 200 is transmitted to analog signal generator means 80 by cable 100. Analog signal from means 80 is transmitted back to means 200 by cable 100. Digital signal from means 200 is transmitted to and from controller/memory means 160 by cable 101. Lock/memory means 200 is mounted on the inside surface 24 of door 22. Power supply means 150, also shown mounted on the inside surface 24 of door 22, can be positioned on the outside of the safe if desired or more convenient. Controller/memory means 160 is mounted on the outside surface of door 22. Means 160 and 200 provide conversion means for converting the analog signal from analog signal generator means 80 to corresponding digital signal, and digital signal to corresponding displacement in inches of leading surface 51.

Means 160 also comprises a data entry means, namely a keypad 161, and display screen 162, for entering information into the locking system for gaining entry into the safe, and for viewing entered and monitored data associated with door condition sensor 20. Data entry includes operating parameters, which include in part a preset set point, a tolerance and a preset set point range.

Figure 13:
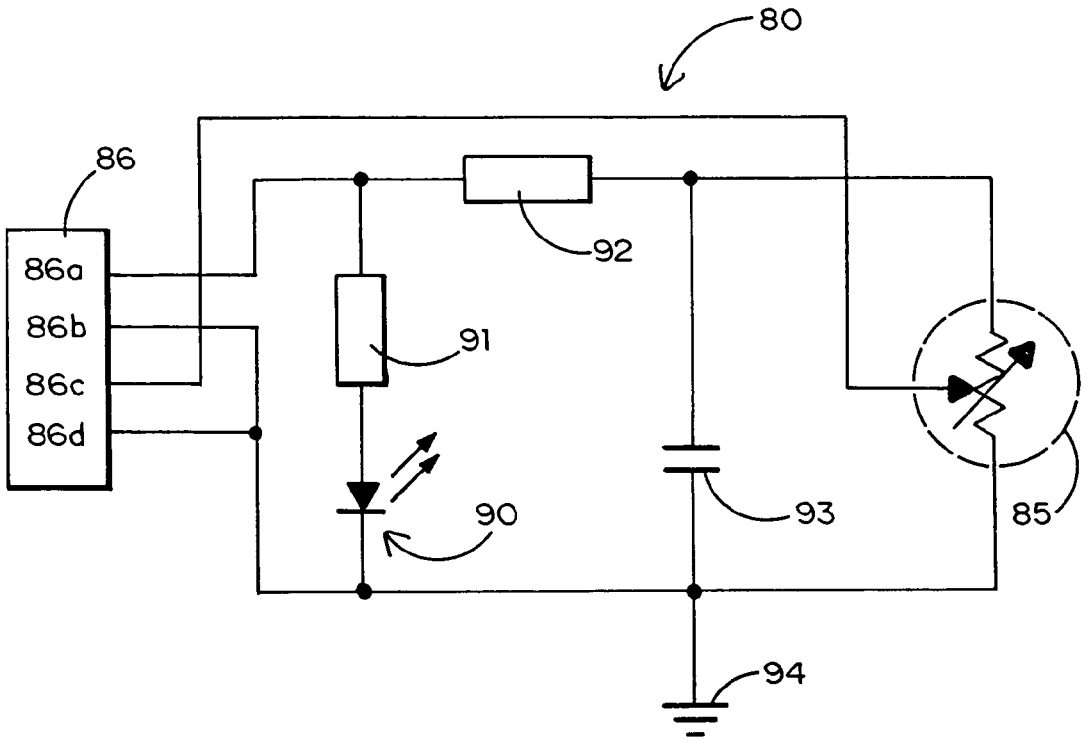
FIG. 13 is the electrical circuit of the analog signal generator means of FIG. 12.

FIG. 13 shows a circuit diagram for analog signal generator means 80 in which electrical elements corresponding to mechanical elements in FIGS. 2–12 have been assigned the same element numbers. In particular the circuit comprises female telephone jack 86 that is shown as an electrical connector. The circuit also comprises resistors 91 and 92, capacitor 93, ground 94, and potentiometer 85 with rotatable part 84 represented electrically by the variable resistor. Terminals 86*a* and 86*b* provide signal input or voltage to means 80 and terminal 86*c* and 86*d* provide analog signal output.

Door condition sensor 20 can be economically produced by plastic molding of the following individual parts, sensor housing 30, frame engageable means 50, rotatable driver 70 and housing cover 120. Furthermore, analog signal generator means 80 can also be inexpensively produced.

Figure 14:
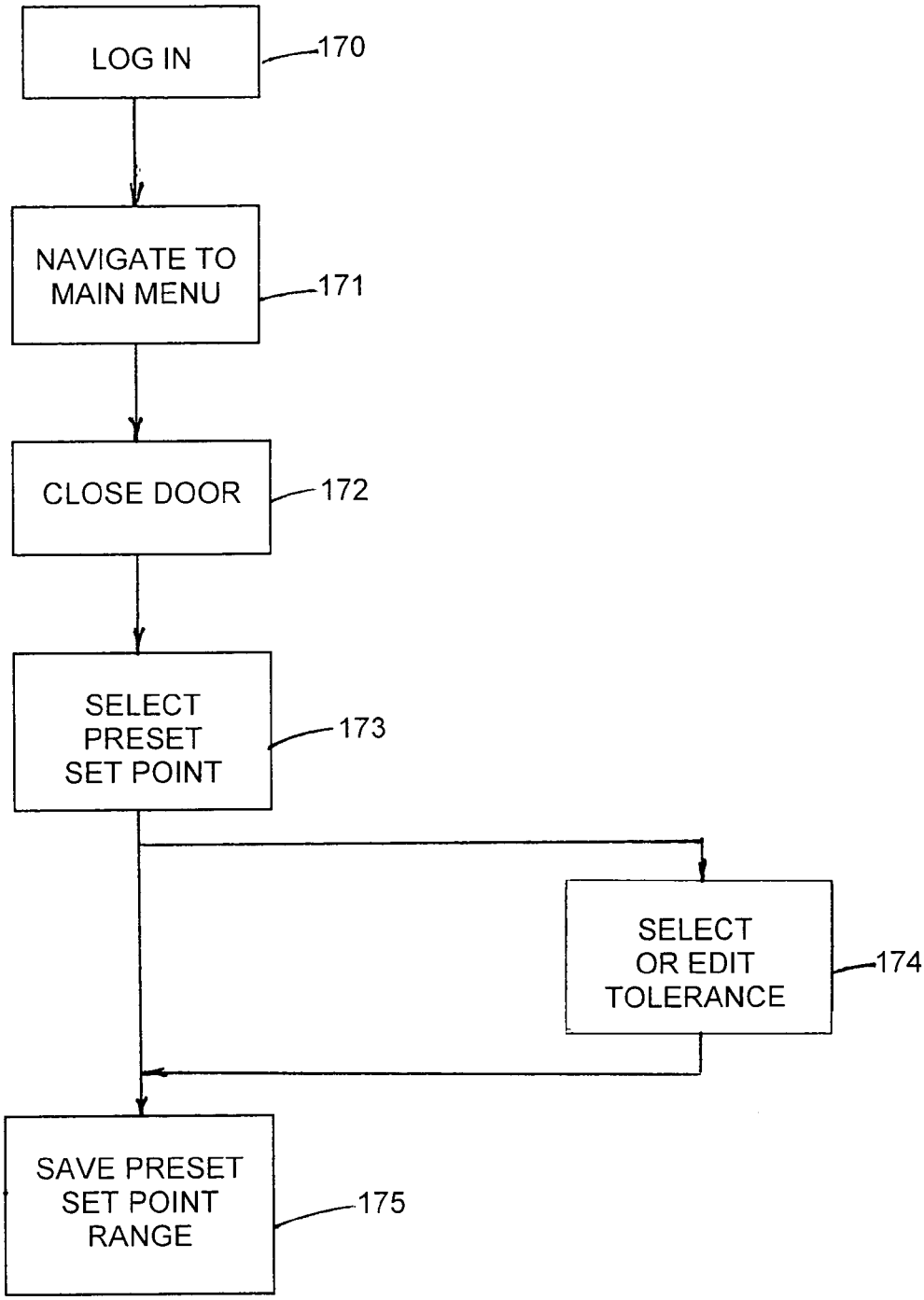
FIG. 14 is a flow chart for setting the initial operating parameters for the door condition sensor.

After the safe is installed in its permanent location, preferably with anchor bolts embedded in high strength cement or concrete, and the basic lock parameters codes entered in the safe's memory through means 160, the owner then enters the initial operating parameters for the door condition sensor 20 for a program such as that illustrated by flow chart of FIG. 14.

In particular the owner will log in by entering his or her personal identity code through keypad 161, or other identity input terminal, as represented in step 170. Using the keypad the owner then navigates to the main menu as represented in step 171.

With door 22 closed as represented by step 172, ramp-shaped leading surface 51 of frame engageable means 50 will be in the closed-door position as shown in FIG. 2. The owner then notes the exact extension or position of leading surface 51 as shown on display screen 162 of means 160. The program converts the analog signal corresponding to the extension or position of ramp-shaped leading surface 51 to a corresponding digital signal and then to corresponding inches of extension.

The initial set up, in one embodiment of this invention, proceeds as follows. If the full extension of ramp-shaped leading surface 51 is ¾ , door condition sensor 20 is mounted on door 22 so that the closed door position of ramp-shaped leading surface 51 is about ⅜ , i.e. about half of the full extension. The owner then selects the noted closed-door extension in inches through keypad 161 as the preset set point as represented in step 173.

Thereafter, each time door 20 is closed the location of ramp-shaped leading surface 51 is compared preset set point by the system's memory. Ideally all future screen displays of the closed-door position or extension will be exactly the same as the preset set point. However, due to wear of mechanical parts of the safe, future closed-door extensions may vary slightly from the initially selected preset set point, for example a few hundredths of an inch. Therefore, to provide for such non-detrimental and acceptable variations in the preset set point, a tolerance is selected using keypad 161 as represented in step 174.

For example, the tolerance can be set to ±0.030 inches. The sum of the preset set point±the tolerance define a preset set point range for the door condition sensor. The preset set point range is also entered and stored in the system's memory as represented by step 175. The preset set point range is then used by the locking system to judge whether or not door 22 is properly closed and whether there has been a time sequence violation or a compromising activity. The preset set point, the tolerance and the preset set point range remains in the locking system's memory until changed.

After setting the operating parameters as described with reference to FIG. 14, the locking system is provided with a program associated with the extension activity of leading surface 51 of frame engageable means 50, for constantly monitoring the safe for time violations and unauthorized activities.

Figure 15:
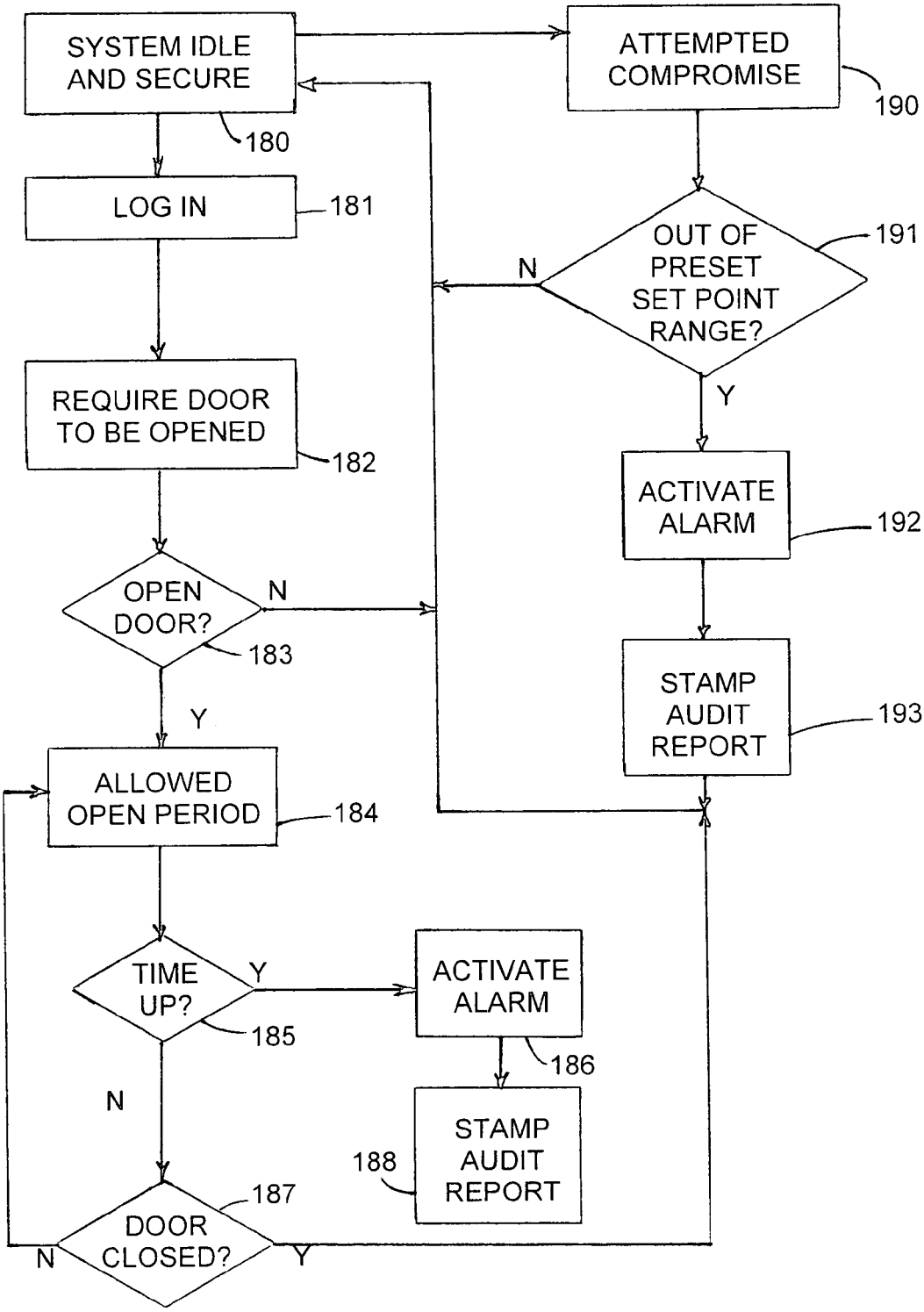
FIG. 15 is a flow chart for monitoring the door condition sensor.

In particular with reference to the program represented by the flow chart of FIG. 15, when the locking system indicates that the extension of leading surface 51 is within its preset set point range and that door 22 is locked, the safe is deemed idle and secure as represented in step 180.

To gain entry a duly authorized person must log in with his or her personal identifier as represented in step 181. If the log in identifier is accepted by the locking system, the safe is ready for entry of the unlocking code. The user can then enter the unlocking code and unlock the safe door as represented by step 182.

Next the program asks if the safe door 22 has been opened as represented by step 183. If after a predetermined allowed unlocking time the safe has not been opened, the program returns to the idle state as represented by step 180. In FIG. 15 the conventional letters N and Y stand for no and yes.

If the safe door is opened within the predetermined unlocking allowed time, the program recalls from memory a previously stored allowed open period as represented by step 184. For example the allowed open period can be set for about 1.5 minutes for a safe used only to store money periodically as it is received in a retail business. The allowed open period will, of course, depend on the actual normal usage of the safe.

In step 185, the program continually compares the time lapse since the safe door is opened with the allowed open period and asks if the allowed open period is up. If the allowed open period is up before the safe door is closed, the system activates an alarm as represented by step 186. The program then stamps an audit record with the time the event occurred as represented by step 188.

If the time has not lapsed, the program continuously asks if the door has been closed as represented by step 187. If the door has been closed and locked, the program returns to step 180 and awaits for further instruction. If the door is still open the program returns to step 184 for continued monitoring of the open door count down time.

The program also continually monitors the safe to determine if there is an attempted compromise as represented by step 190. This is accomplished by the program continually asking if leading surface 51 of door condition sensor 20 is out of the preset set point range as represented by step 191. If the door condition sensor and program indicate that leading surface 51 is out of preset set point range that may indicate that someone is testing the safe for ways to circumvent the program, or that someone is prying on the door, or that the door is partly but not completely closed, or for another reason that may not be associated with normal activity of the safe.

If the program indicates that the door condition sensor is out of preset set point range the program activates an alarm as represented by step 192. The program then stamps an audit record with the time the event occurred as represented by step 193. However, if the program indicates that the door condition sensor is not out of preset set point range, the program then reverts to the idle and secure state as represented by step 180.

Thus, when a suspect activity occurs, the program stamps the event thereby producing a retrievable record of such events for subsequent evaluation by security personnel. The audit trail can be used for aiding in the determination of whether the tampering activity was by authorized personnel or by an unauthorized person such as a burglar. By connecting a printer to printer connector port 152 in power supply means 150, printed audit reports can be produced.

Therefore, the door condition sensor 20 and the locking system of this invention provides both means for determining (1) whether there has been any activity which violates predetermined set time limits for the door 22 to be open, and (2) whether there has been any activity that would suggest that a compromising activity has occurred.

While the preferred embodiments of the present invention have been described, various changes, adaptations and modifications may be made thereto without departing from the spirit of the invention and the scope of the appended claims. The present disclosure and embodiments of this invention described herein are for purposes of illustration and example and modifications and improvements may be made thereto without departing from the spirit of the invention or from the scope of the claims. The claims, therefore, are to be accorded a range of equivalents commensurate in scope with the advances made over the art.

What is claimed is:

1. A door condition sensor for a chamber having an entry door and a door frame therefor comprising:

a. a sensor housing adaptable for mounting on an inside surface of the door;

b. frame engageable means for abutting the door frame when the door is completely closed, the frame engageable means being slideably mounted in the sensor housing and confined to linear displacement therein;

c. rotatable driver means rotatably mounted in the sensor housing at a fixed axial location therein, the rotatable driver means being rotatably driven by the frame engageable means, the rotatable driver means for transforming linear displacement of the frame engageable means into corresponding rotational orientation of the rotatable driver means;

d. analog signal generator means mounted in the sensor housing having a rotatable part driven by the rotatable driver means and having an axis coinciding with the fixed axial location in the sensor housing, the analog signal generator means for producing analog signals corresponding to the rotational orientation of the rotatable part of the analog signal generator means; and e. biasing means for extending a part of the frame engageable means away from the sensor housing and for maintaining the frame engageable means against the door frame when the door is completely closed.

2. The door condition sensor of claim 1, further comprising fastening means for fastening the sensor housing to the inside surface of the door.

3. The door condition sensor of claim 1, wherein the analog signal generator means includes a potentiometer.

4. The door condition sensor of claim 1, wherein the frame engageable means has a ramp-shaped leading surface for striking and abutting a jamb of the door frame as the door is closed, so that frame engageable means is easily displaced into the sensor housing.

5. The door condition sensor of claim 1, wherein the rotatable driver means is a segmented gear having outwardly extending gear teeth, and wherein the frame engageable means has a linear set of complementary gear teeth inwardly extending for engaging the outwardly extending gear teeth of the rotatable driver means.

6. The door condition sensor of claim 1, wherein the biasing means is coil extension spring.

7. The door condition sensor of claim 6, wherein the sensor housing has a channel for holding a portion of the coil extension spring when the door is completely open, and for holding approximately the entire coil extension spring when the door is completely closed.

8. The door condition sensor of claim 7, wherein the frame engageable means has a prong for axial insertion into one end of the coil extension spring for maintaining the coil extension spring in a straight line at all extensions of the frame engageable means from the sensor housing.

9. The door condition sensor of claim 1, wherein the biasing means is also for maintaining the frame engageable means against a part of the door frame when the door is nearly closed.

10. The door condition sensor of claim 1, further comprising a housing cover removably attached to the sensor housing for confining a portion of the frame engageable means within the sensor housing and the housing cover, and for maintaining a slidable linear relationship of the frame engageable means relative to the sensor housing.

11. The door condition sensor of claim 10, wherein the housing cover includes means for preventing the frame engageable means from being completely removed from the sensor housing.

12. The door condition sensor of claim 10, wherein the frame engageable means has a linear stop slot, and wherein the housing cover has an internal stop positioned within the linear stop slot, the linear stop slot and internal stop for confining the linear movement of the frame engageable means between approximately a closed-door position and an opened-door position.

13. The door condition sensor of claim 10, further comprising fastening means for securing the housing cover to the sensor housing.

14. The door condition sensor of claim 1, further comprising conversion means for converting analog signals from the analog signal generator means to corresponding digital signals.

15. The door condition sensor of claim 14, wherein the corresponding digital signals are proportional to linear displacement of the frame engageable means.

16. The door condition sensor of claim 14, further comprising means for receiving the digital signal from the conversion means, and for converting the digital signal to a distance parameter indicative of present extension of frame engageable means relative to the sensor housing.

17. The door condition sensor of claim 16, further comprising means electrically linked to the door condition sensor, for entering a preset set point corresponding to a distance that the frame engageable means is extended when the door is completely closed.

18. The door condition sensor of claim 17, further comprising means for entering a tolerance for an acceptable deviation from the preset set point thereby defining a preset set point range.

19. The door condition sensor of claim 18, further comprising a tampering alarm, means for identifying a door closing that is not normal and thereby may indicate a tampering or a compromising of security of the chamber, and means for activating the tampering alarm in event of said tampering or comprising.

20. The door condition sensor of claim 18, further comprising a tampering alarm, means for identifying non-normal displacements of the frame engageable means that are not within the preset set point range, and means for activating the tampering alarm in event of the non-normal displacements.

21. The door condition sensor of claim 20, further comprising means for time stamping each occurrence of an activation of the tampering alarm.

22. The door condition sensor of claim 21, further comprising means for producing a retrievable chronological record of each time stamping.

23. The door condition sensor of claim 14, further comprising a time alarm, and means for entering an allowed open period for the door to be open and for activating the time alarm when lapsed time that the door remains open exceeds the allowed open period.

24. The door condition sensor of claim 23, further comprising means for time stamping each occurrence of an activation of the time alarm.

25. The door condition sensor of claim 24, further comprising means for producing a retrievable chronological record of each time stamping.

26. A door condition sensor for a chamber having an entry door and a door frame therefor comprising:

a. a sensor housing adaptable for mounting on an inside surface of the door;

b. frame engageable means for abutting the door frame when the door is completely closed, the frame engageable means being slideably mounted in the sensor housing and confined to linear displacement therein;

c. rotatable driver means rotatably mounted in the sensor housing at a fixed axial location therein, the rotatable driver means being rotatably driven by the frame engageable means, the rotatable driver means for transforming linear displacement of the frame engageable means into corresponding rotational orientation of the rotatable driver means;

d. analog signal generator means mounted in the sensor housing having potentiometer with a rotatable part driven by the rotatable driver means and having an axis coinciding with the fixed axial location in the sensor housing, the analog signal generator means for producing analog signals corresponding to the rotational orientation of the rotatable part of the analog signal generator means;

e. a spring for extending a part of the frame engageable means away from the sensor housing and for maintaining the frame engageable means against the door frame when the door is completely closed; and f. a housing cover removably attached to the sensor housing for confining a portion of the frame engageable means within the sensor housing and the housing cover, and for maintaining a slidable linear relationship of the frame engageable means relative to the sensor housing.

27. The door condition sensor of claim 16, further comprising conversion means for converting analog signals from the analog signal generator means to corresponding digital signals that are proportional to linear displacement of the frame engageable means.

* * * * *